US007152285B2

(12) United States Patent
Liao

(10) Patent No.: US 7,152,285 B2
(45) Date of Patent: Dec. 26, 2006

(54) SHOE LACE FASTENING DEVICE

(76) Inventor: Cheng-Naang Liao, No. 57, Pinghe Rd., Daya Township, Taichung County 428 (TW)

( * ) Notice: Subject to any disclaimer, the term of this patent is extended or adjusted under 35 U.S.C. 154(b) by 0 days.

(21) Appl. No.: 11/022,253

(22) Filed: Dec. 22, 2004

(65) Prior Publication Data

US 2006/0130297 A1 Jun. 22, 2006

(51) Int. Cl.
*A43C 7/00* (2006.01)
*F16G 11/00* (2006.01)
*F16G 11/10* (2006.01)

(52) U.S. Cl. ..... 24/712.5; 24/115 G; 24/712.7

(58) Field of Classification Search ..... 24/575.1, 24/581.1, 712.1, 712.5, 712.7, 712.8, 335, 24/712.9, 338, 347, DIG. 33, DIG. 48, DIG. 37
See application file for complete search history.

(56) References Cited

U.S. PATENT DOCUMENTS 4,389,759 A * 6/1983 Yuda ..... 24/614
4,393,550 A * 7/1983 Yang et al. ..... 24/712.5

* cited by examiner

*Primary Examiner*—Jack W. Lavinder
(74) *Attorney, Agent, or Firm*—Alan D. Kamrath; Nikolai & Mersereau, P.A.

(57) ABSTRACT

A shoe fastening device includes a body having two open ends and two push members are movably inserted in the body from the two open ends and a spring is connected between the two push members. Two ends of a string extend through two passages in the two push members and two holes in the body. A side frame extends from an outer periphery of the body and includes a space defined therethrough. Two apertures are defined through the side frame and communicate with the space. A rib extends from an inside of an inside of the space and is located between the two apertures. A positioning member is removably connected to the side frame via the two apertures and the two ends of the string is positioned at the clamp portions of the positioning member.

6 Claims, 11 Drawing Sheets

SHOE LACE FASTENING DEVICE

FIELD OF THE INVENTION

The present invention relates to a shoe lace fastening device that is able to fasten and unfasten the shoe lace within a short period of time.

BACKGROUND OF THE INVENTION

As shown in FIG. 13, a show lace is used to tighten the two flaps of a shoe and the shoe lace is tightened by several steps which require a lot of time to finish. The same steps are taken in reverse sequence when unfastening the shoe lace if the shoe is to be taken off and then, the shoe lace is fastened again every time the shoe is put on. Obviously, the conventional way to fasten or unfasten the shoe lace is time-consuming and cannot meet requirements of people today. FIG. 14 shows a fastening device 1 that is usually used for fastening two ends of a string of back bags or sport clothes. The device 1 generally includes a body 11 with a close end and an open end form which a flange 111 extends inward so as to limit movement of a push member 13 which has one end inserted in the body 11 form the open end and the other end extends from the open end. A spring 12 is biased between the close end of the body 11 and the push member 13 so that the push member 13 has a tendency to move toward the open end of the body 11. Two holes 112 are defined through a wall of the body 11 and a passage 131 is defined through the push member 13. Two ends of the string 2 extend through the holes 112 and the passage 131. When the holes 112 and the passage 131 are located in alignment with each other by pushing the push member 13 inward the body 11, the string 2 can be freely moved by the user. On the contrary, when releasing the push member 13, the spring 12 pushes the push member 13 and the passage 131 is not in alignment with the holes 112 so that the string 2 is biased by the push member 13 and secured. However, it is noted that the spring 12 cannot provide enough force to firmly position the string 2 which can be forcibly pulled easily, and this is the reason why that the fastening device 1 is not used to fasten shoe lace.

The present invention intends to provide a show lace fastening device wherein the shoe lace can be easily fastened or unfastened by pushing two push members of the fastening device.

SUMMARY OF THE INVENTION

The present invention relates to a shoe fastening device which comprises a tubular and hollow body having two open ends and each open end has a flange extending from an inner periphery thereof. Two holes are defined radially through the body. Two push members each have a stop flange at a first end thereof and the two push members are inserted into the body from the two open ends by their two respective first ends. The two respective second ends of the push members extend from the two open ends of the body and are connected with two respective caps. Each of the two push members has a passage defined radially therethrough and a biasing member is connected between the two respective first ends of the two push members which are pushed toward the two open ends of the body by the biasing member. A side frame extends from an outer periphery of the body and includes a space defined therethrough. Two apertures are defined through the side frame and communicate with the space. A rib extends from an inside of an inside of the space and is located between the two apertures. A positioning member is removably connected to the side frame via the two apertures.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
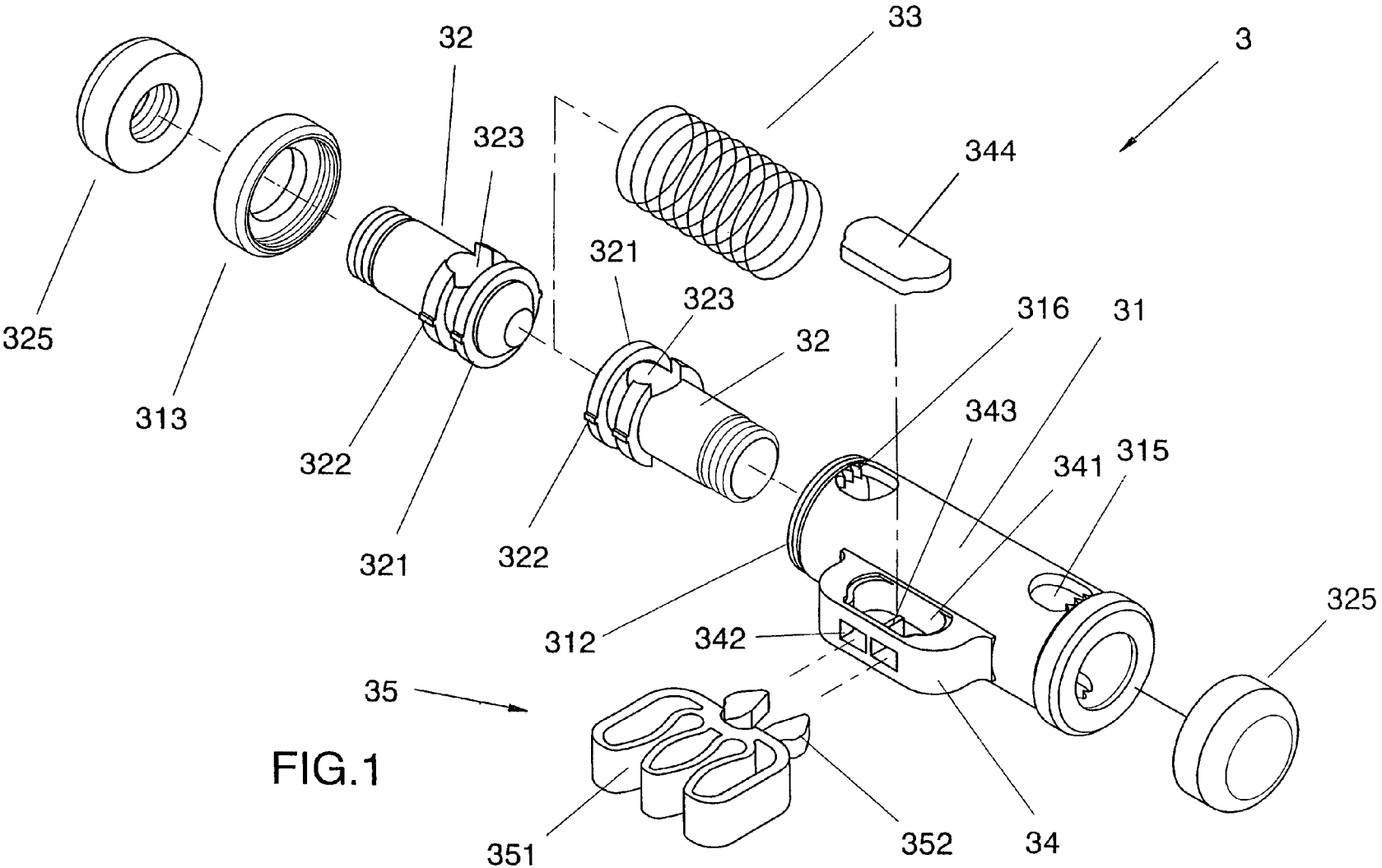
FIG. 1 is an exploded view to show the shoe lace fastening device of the present invention.
Figure 2:
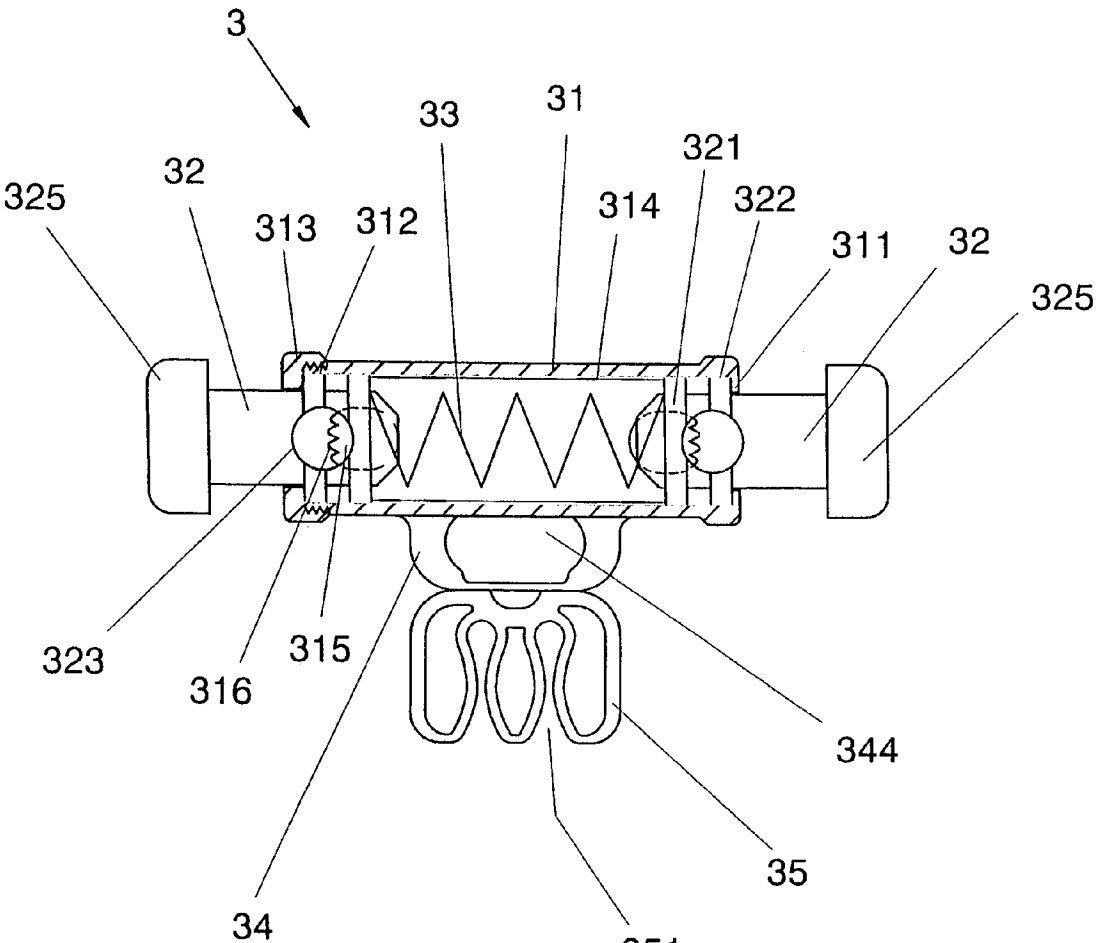
FIG. 2 is a side cross sectional view of the shoe lace fastening device of the present invention.
Figure 3:
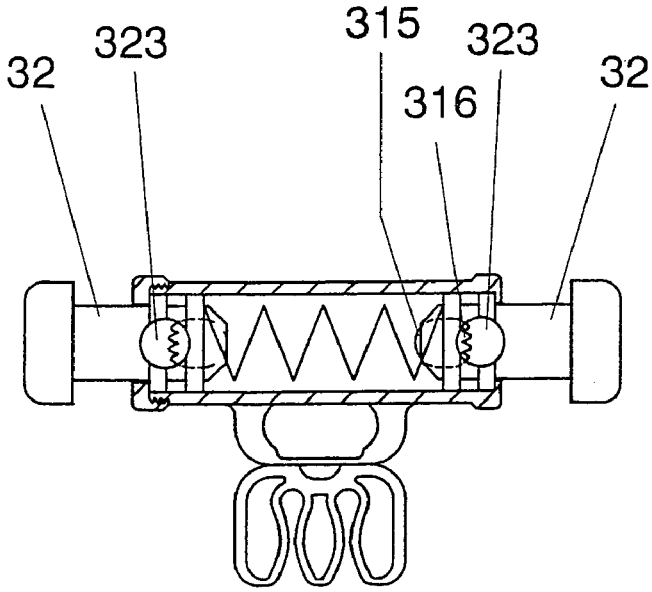
FIG. 3 shows the shoe lace fastening device wherein no shoe lace is connected with the fastening device.
Figure 4:
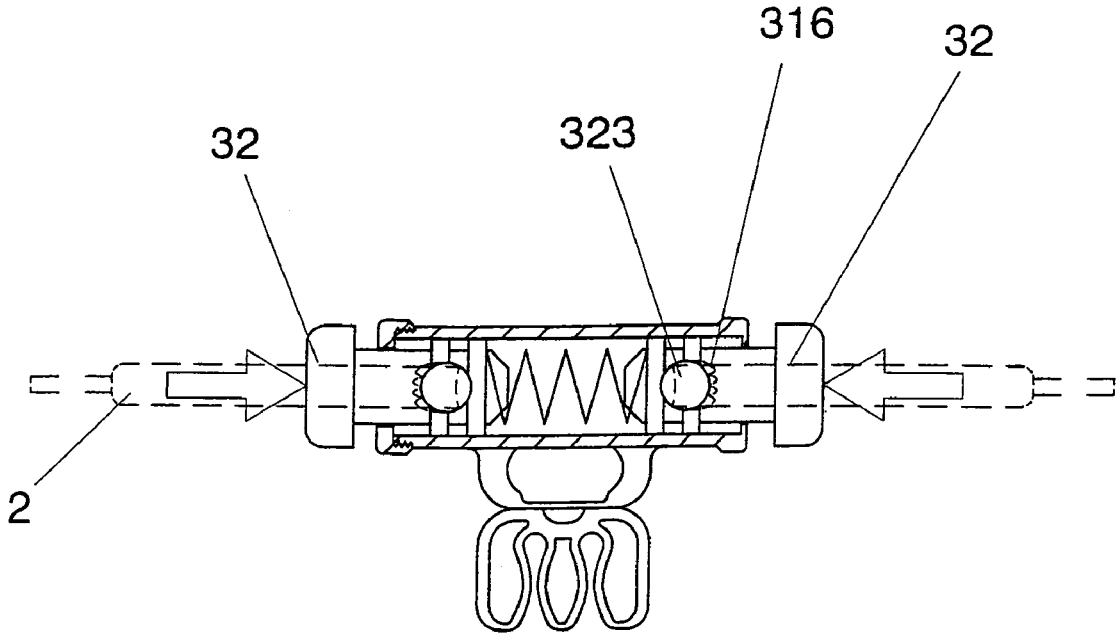
FIG. 4 shows that the a shoe lace is to be connected to the shoe lace fastening device of the present invention.
Figure 5:
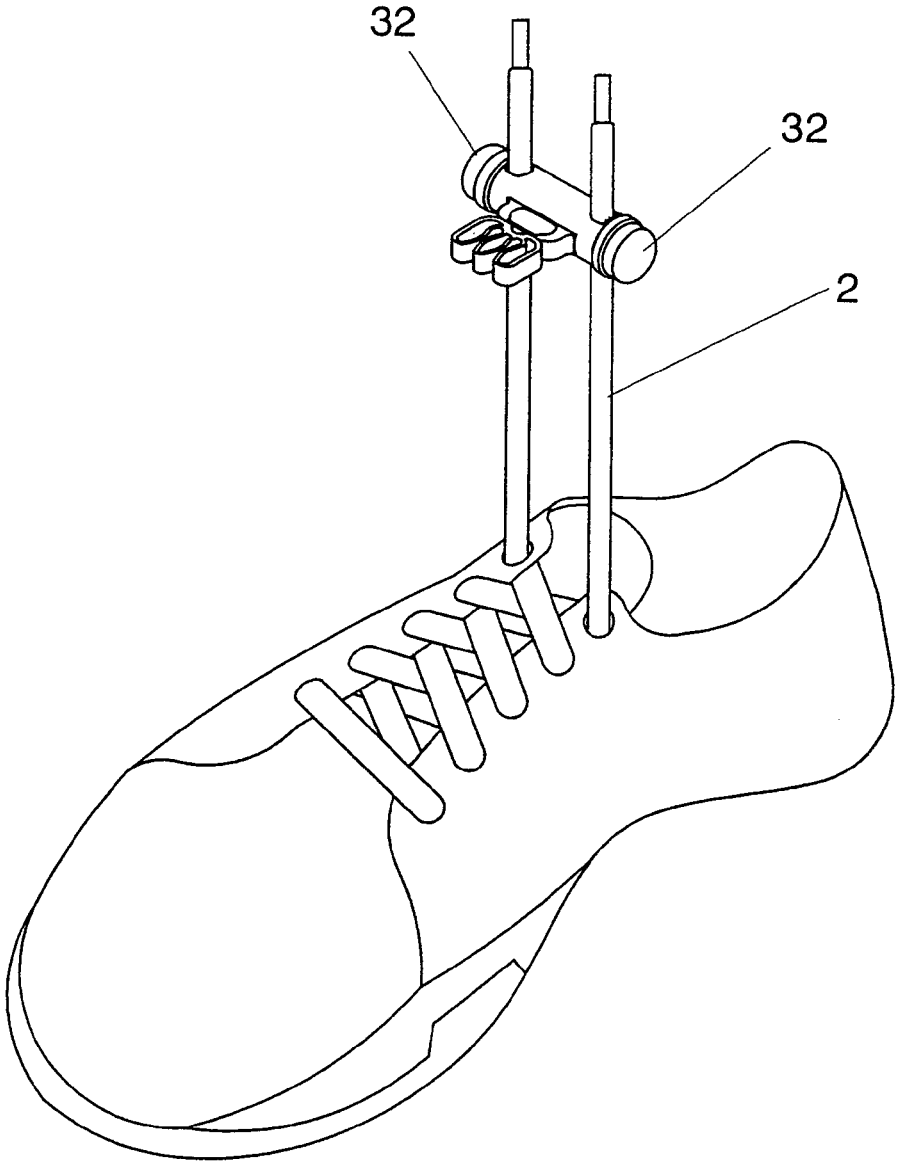
FIG. 5 shows the fastening device is about to tighten a shoe lace to the show lace to a shoe.

Referring to FIGS. 1 to 5, the shoe fastening device 3 of the present invention comprises a tubular hollow body 31 which includes two open ends and a collar is fixed to one open end and the other open end includes a threaded portion 312 defined in an outer periphery thereof so that another collar 313 can be threadedly connected to the threaded portion 312. Each open end has a flange 311 extending from an inner periphery thereof and two holes 315 are defined radially through the body 31. Teeth 316 are defined in an inside of each of the holes 315 of the body 31.

Two push members 32 each have a stop flange 321 at a first end thereof and the two push members 32 are inserted into the body 31 from the two open ends by their two respective first ends. The push members 32 are then prevented from dropping out from the open ends of the body 31 when the stop flanges 321 are in contact with the flange 311 of the body 31. Two respective second ends of the push members 32 extend through the two collars 313 and the two open ends of the body 31 and are connected with two respective caps 325. Each of the two push members 32 has a passage 323 defined radially therethrough and a biasing member 33 is connected between the two respective first ends of the two push members 32 which are pushed toward the two open ends of the body 31 by the biasing member 33. A key 322 extends axially on the stop flange 321 of each of the two push members 32 and a groove 314 is defined axially in an inner periphery of the body 31 so that the two respective keys 322 of the two push members 32 are engaged with the groove 314 so that the push members 32 only move axially in the body 31 and cannot rotate.

A side frame 34 extends from an outer periphery of the body and includes a space 341 defined therethrough which is covered by a cover 344. Two apertures 342 are defined through the side frame 34 and communicate with the space 341. A rib 343 extends from an inside of an inside of the space 341 and is located between the two apertures 342. By the rib 343, the structural strength of the frame 34 is reinforced.

A positioning member 35 is an M-shaped hollow member and has a clamping portion 351 at one end and two insertions 352 extend from the other end of the positioning member 35. The clamping portion 351 includes three protrusion and two gaps are defined between the protrusions. Each gap has a wide opening which communicates with a narrow space which communicates with an enlarged space. The two insertions 352 are flexible and can be inserted into the two apertures 342 of the side frame 34 by squeezing them together and removed from the apertures 342 by the same way.

Two ends of a shoe lace 2 coming out from the two flaps 4 (FIG. 6) of a shoe extends through the two push members 32 from two respective central holes in the caps 325 and then extend through the passages 323 of the two push members 32 and the holes 315 of the body 31

Figure 6:
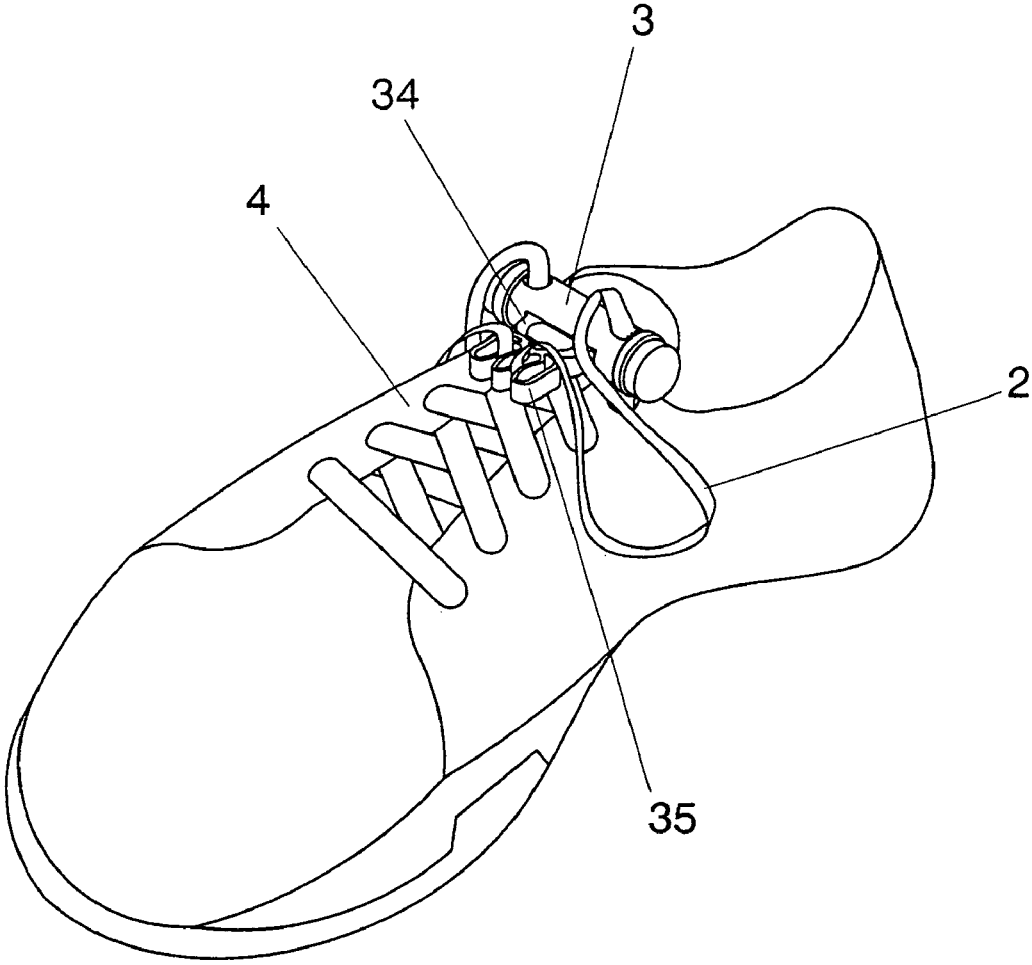
FIG. 6 shows that the fastening device tightens the shoe lace of the shoe.
Figure 7:
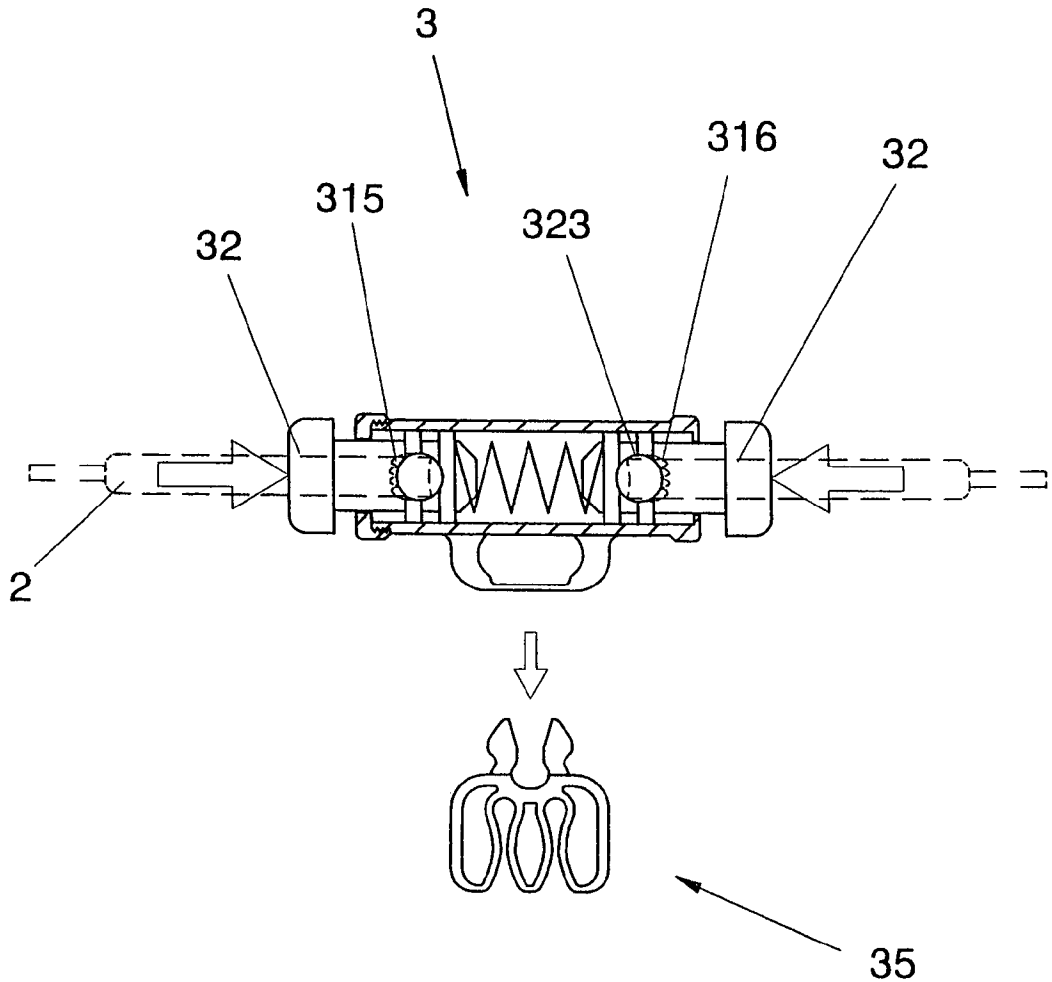
FIG. 7 shows that the positioning member is removed from the body of the shoe lace fastening device of the present invention.
Figure 8:
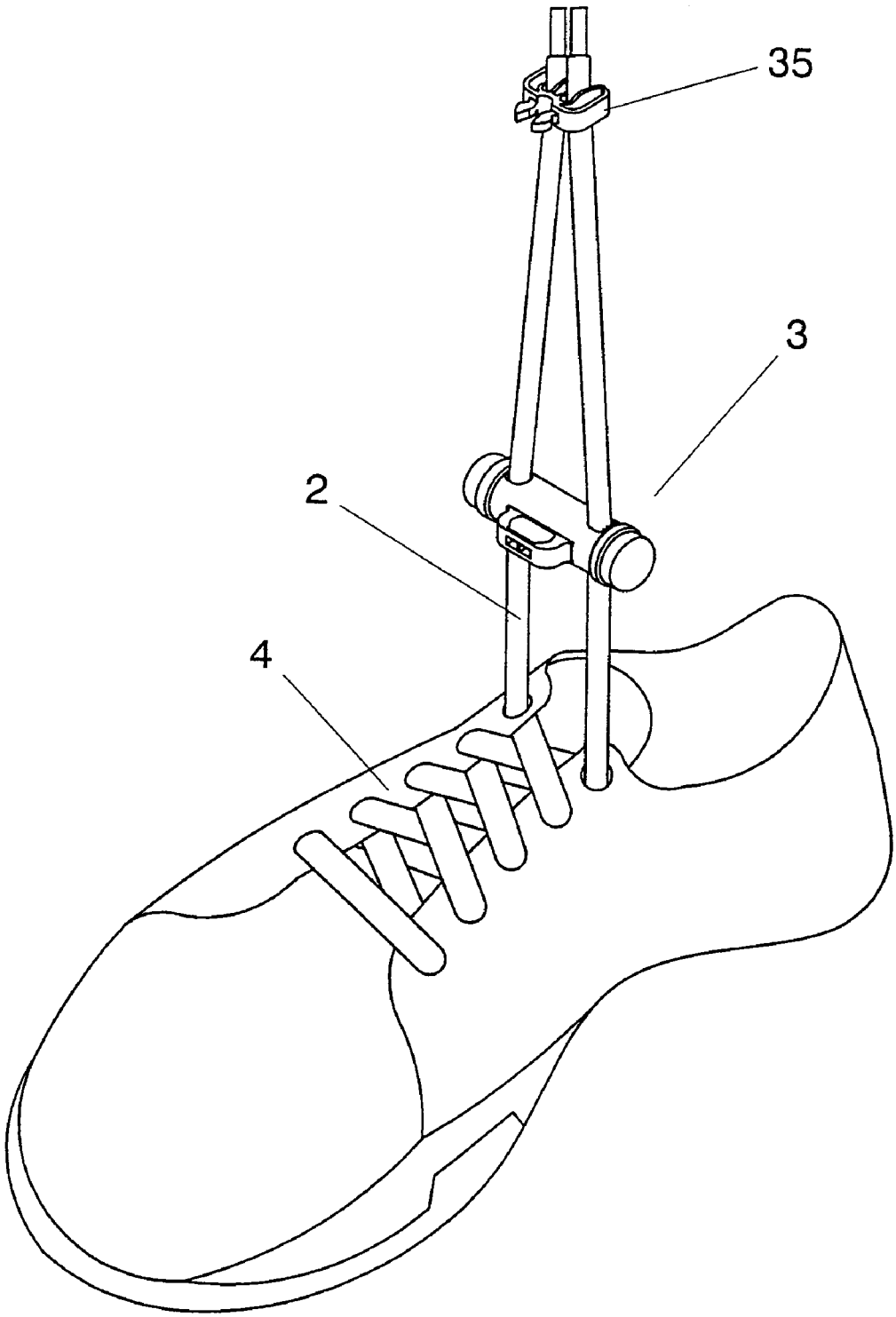
FIG. 8 shows the shoe lace is pulled to close the two flats of the shoe.

As shown in FIGS. 6 to 8, when tightening the shoe lace 2, the positioning member 35 is first removed from the side frame 34 by squeezing the two insertions 352 toward each other and removing them from the apertures 342. The two ends of the shoe lace 2 are then clamped in the two gaps by squeezing the protrusions of the clamp portion 351. The user pushes the two push members 32 to align the passages 323 with the holes 315, and then lifts the positioning member 35 to pull the flats 4 as close as possible. The push members 32 are released when the desired tightness of the shoe lace is reached and the positioning member 35 is then re-connected to the side frame 34 again. The shoe lace 2 is then secured by the force of the biasing member 33. The shoe lace 2 can be fastened without making a complicated knot and this is especially suitable for use by elders and children.

Figure 9:
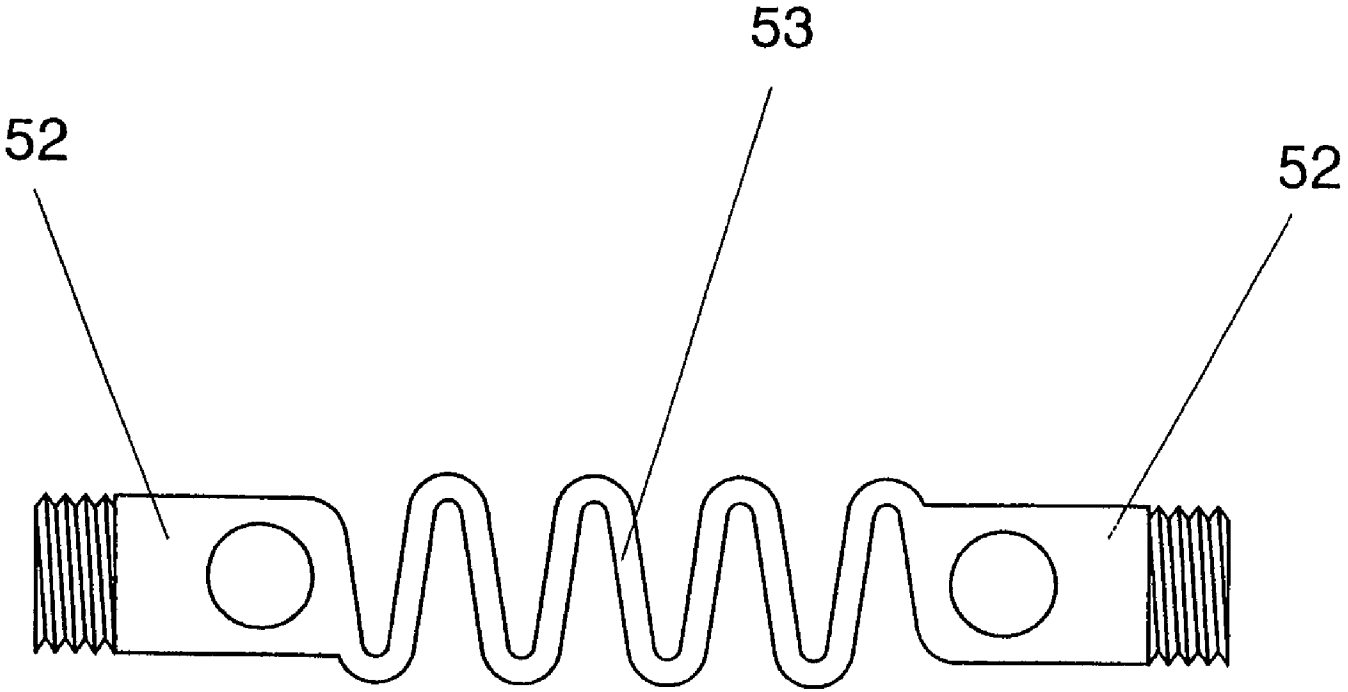
FIG. 9 shows that the tow push members and the biasing member are made as a one piece.
Figure 10:
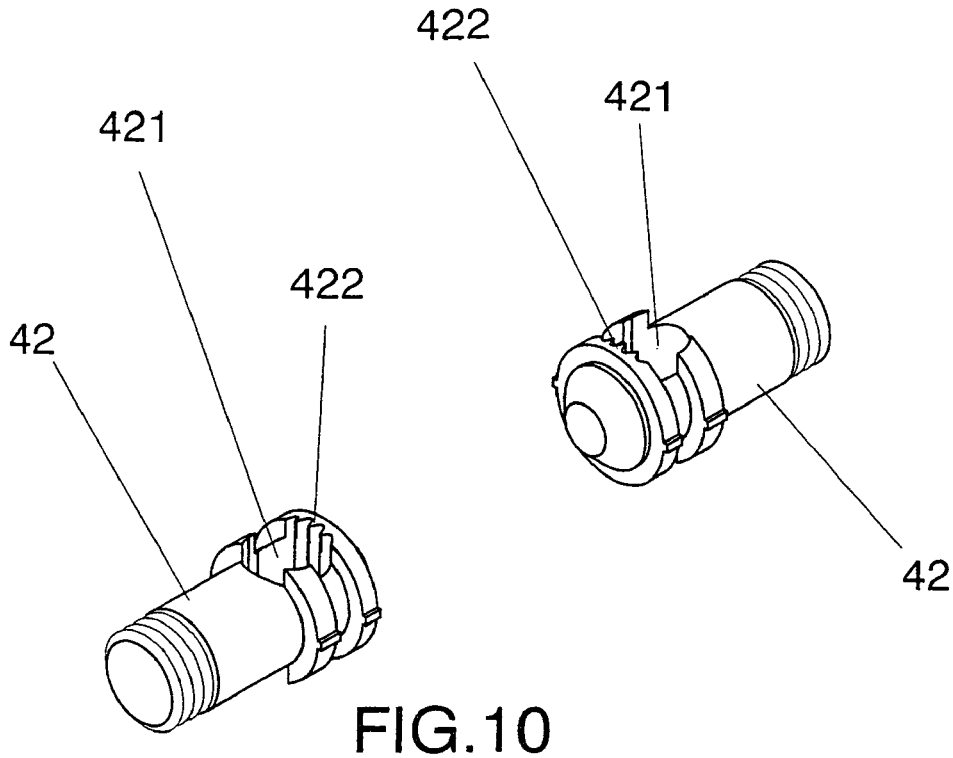
FIG. 10 shows that teeth are defined in an inside of the passage of the push member.
Figure 11:
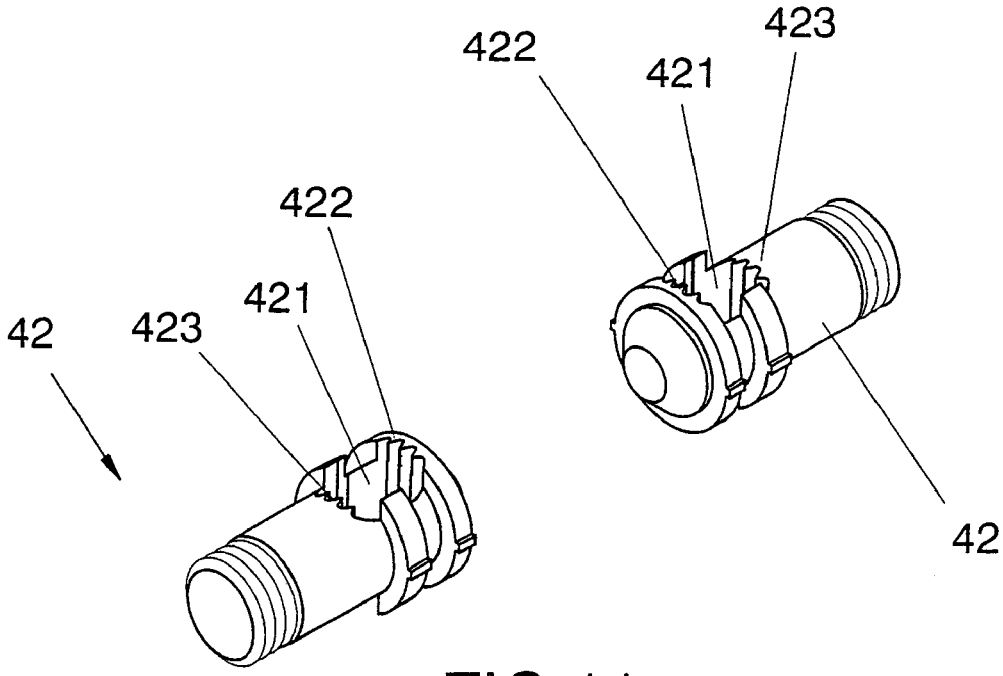
FIG. 11 shows that teeth are defined in two opposite insides of the passage of the push member.

As shown in FIG. 9, the two push members 52 and the biasing member 53 can be made as a one piece. FIG. 10 shows that each of the passages 421 of the two push members 42 includes teeth piece 422 defined in an inner periphery thereof so that the shoe lace 2 can be firmly secured by the teeth 316 of the body 31 and the teeth of the push members 42. FIG. 11 shows that the teeth 422, 423 are defined in two opposite insides of the passage 421 of each of the push members 42 to provide more secure feature to the shoe lace 2.

Figure 12:
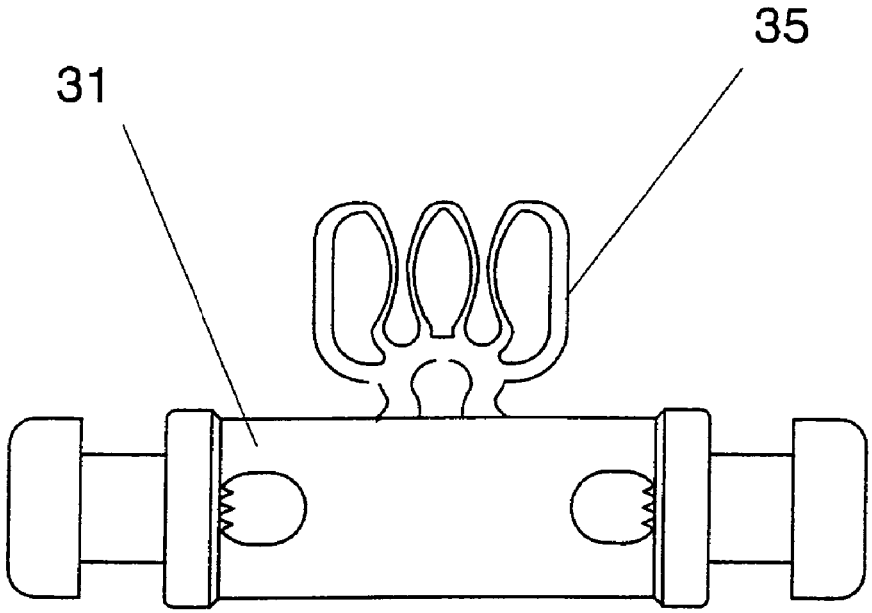
FIG. 12 shows that the positioning member and the body are made as a one piece.
Figure 13:
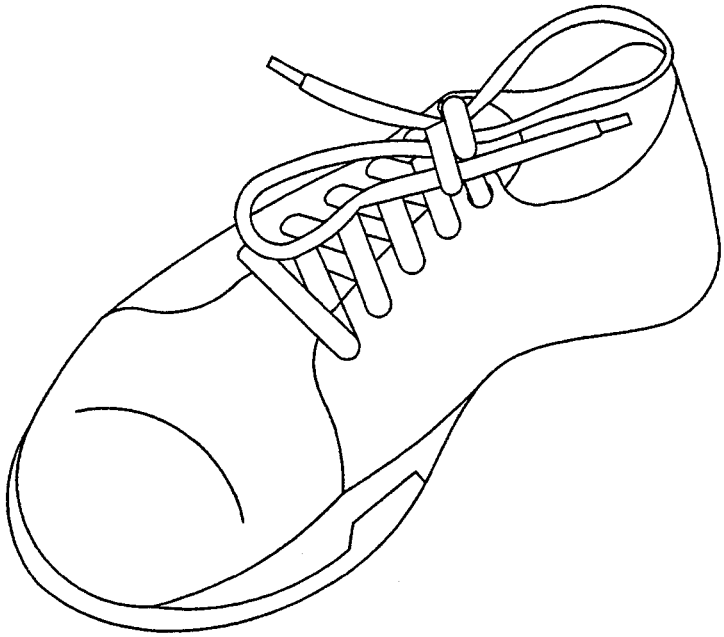
FIG. 13 shows a shoe with a shoe lace.
Figure 14:
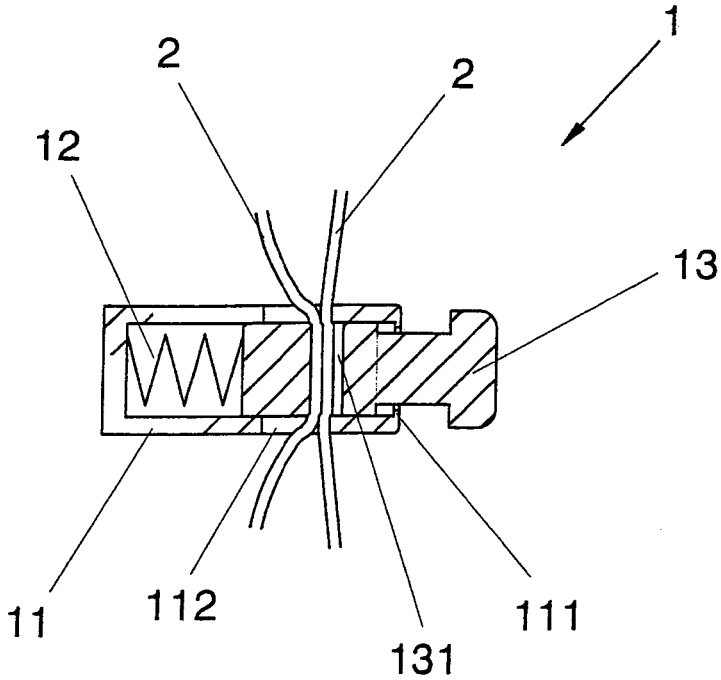
FIG. 14 shows a conventional fastening device.

FIG. 12 shows that the positioning member 35 and the body 31 may also be made as a one piece so that the user may fasten the shoe lace 2 without using the positioning member 35.

The side frame 34 of the fastening device 3 is reinforced by the rib 343 so that it has a longer term of use and the teeth 316, 422, 423 firmly secure the shoe lace 2 so that the fastening device 3 can be used on shoes and the shoe lace 2 can be quickly fastened and unfastened. The positioning member 35 can be made into desired shapes and can be conveniently disconnected from the side frame 34 when needed. The push members 32 can only be pushed axially so that the users do not need to rotate and align the push members 32. The push members 52 and the biasing member 53 can be made as a one piece which reduces manufacturing cost.

While we have shown and described the embodiment in accordance with the present invention, it should be clear to those skilled in the art that further embodiments may be made without departing from the scope of the present invention.

What is claimed is:

1. A shoe fastening device (3) comprising:

a body (31) which is a tubular and hollow member and includes two open ends, each open end having a flange (311) extending from an inner periphery thereof, two holes (315) defined radially through the body (31);

two push members (32) each having a stop flange (321) at a first end thereof and the two push members (32) being inserted into the body (31) from the two open ends by their two respective first ends, the two push members (32) being prevented from dropping out from the open ends of the body (31) when the stop flanges (321) are in contact with the flange (311) of the body (31), two respective second ends of the two push members (32) extending from the two open ends of the body (31) and connected with two respective caps (325), each of the two push members (32) having a passage (323) defined radially therethrough, a biasing member (33) connected between the two respective first ends of the two push members (32) which are pushed toward the two open ends of the body (31), and a side frame (34) extending from an outer periphery of the body (31) and including a space (341) defined therethrough, two apertures (342) defined through the side frame (34) and communicating with the space (341), a rib (343) extending from an inside of an inside of the space (341) and located between the two apertures (342), a positioning member (35) removably connected to the side frame (34) via the two apertures (342);

wherein, teeth (316) are defined in an inside of each of the holes (315) of the body (31).

2. The device as claimed in claim 1, wherein the two push members (52) and the biasing member (53) are made as a one piece.

3. The device as claimed in claim 1, wherein the positioning member (35) and the body (31) are made as a one piece.

4. A shoe fastening device (3) comprising:

a body (31) which is a tubular and hollow member and includes two open ends, each open end having a flange (311) extending from an inner periphery thereof, two holes (315) defined radially through the body (31);

two rush members (32) each having a stop flange (321) at a first end thereof and the two push members (32) being inserted into the body (31) from the two open ends by their two respective first ends, the two push members (32) being prevented from dropping out from the open ends of the body (31) when the stop flanges (321) are in contact with the flange (311) of the body (31), two respective second ends of the two push members (32) extending from the two open ends of the body (31) and connected with two respective caps (325), each of the two push members (32) having a passage (323) defined radially therethrough, a biasing member (33) connected between the two respective first ends of the two push members (32) which are pushed toward the two open ends of the body (31), and a side frame (34) extending from an outer periphery of the body (31) and including a space (341) defined therethrough, two apertures (342) defined through the side frame (34) and communicating with the space (341), a rib (343) extending from an inside of an inside of the space (341) and located between the two apertures (342), a positioning member (35) removably connected to the side frame (34) via the two apertures (342), wherein a key (322) extends axially on the stop flange (321) of each of the two push members (32) and a groove (314) is defined axially in an inner periphery of the body (31) so that the two respective keys (322) of the two push members (32) are engaged with the groove (314) so that the push members (32) move axially in the body (31).

5. A shoe fastening device (3) comprising:

a body (31) which is a tubular and hollow member and includes two open ends, each open end having a flange (311) extending from an inner periphery thereof, two holes (315) defined radially through the body (31);

two push members (32) each having a stop flange (321) at a first end thereof and the two push members (32) being inserted into the body (31) from the two open ends by their two respective first ends, the two push members (32) being prevented from dropping out from the open ends of the body (31) when the stop flanges (321) are in contact with the flange (311) of the body (31), two respective second ends of the two push members (32) extending from the two open ends of the body (31) and connected with two respective caps (325), each of the two push members (32) having a passage (323) defined radially therethrough, a biasing member (33) connected between the two respective first ends of the two push members (32) which are pushed toward the two open ends of the body (31), and a side frame (34) extending from an Outer periphery of the body (31) and including a space (341) defined therethrough, two apertures (342) defined through the side frame (34) and communicating with the space (341), a rib (343) extending from an inside of an inside of the space (341) and located between the two apertures (342), a positioning member (35) removably connected to the side frame (34) via the two apertures (342), wherein the positioning member (35) is an M-shaped hollow member and having a clamping portion (351) at one end and two insertions (352) extend from the other end of the positioning member (35), the clamping portion (351) having a wide opening which communicates with a narrow space which communicates with an enlarged space, the two insertions (352) being flexible and inserted into the two apertures (342) of the side frame (34).

6. A shoe fastening device (3) comprising:

a body (31) which is a tubular and hollow member and includes two open ends, each open end having a flange (311) extending from an inner periphery thereof, two holes (315) defined radially through the body (31);

two rush members (32) each having a stop flange (321) at a first end thereof and the two push members (32) being inserted into the body (31) from the two open ends by their two respective first ends, the two push members (32) being prevented from dropping out from the open ends of the body (31) when the stop flanges (321) are in contact with the flange (311) of the body (31), two respective second ends of the two push members (32) extending from the two open ends of the body (31) and connected with two respective caps (325), each of the two push members (32) having a passage (323) defined radially therethrough, a biasing member (33) connected between the two respective first ends of the two push members (32) which are pushed toward the two open ends of the body (31), and a side frame (34) extending from an outer periphery of the body (31) and including a space (341) defined therethrough, two apertures (342) defined through the side frame (34) and communicating with the space (341), a rib (343) extending from an inside of an inside of the space (341) and located between the two apertures (342), a positioning member (35) removably connected to the side frame (34) via the two apertures (342), wherein each of the passages (421) of the two push members (42) includes two teeth pieces (422, 423) oppositely defined in an inner periphery thereof.

* * * * *